United States Patent [19]

Ramanan

[11] 4,439,253

[45] Mar. 27, 1984

[54] COBALT RICH MANGANESE CONTAINING NEAR-ZERO MAGNETOSTRICTIVE METALLIC GLASSES HAVING HIGH SATURATION INDUCTION

[75] Inventor: V. R. V. Ramanan, Randolph, N.J.

[73] Assignee: Allied Corporation, Morristown, N.J.

[21] Appl. No.: 354,824

[22] Filed: Mar. 4, 1982

[51] Int. Cl.³ ..... C22C 19/00

[52] U.S. Cl. ..... 148/403; 148/420; 420/435; 420/436

[58] Field of Search ..... 148/403, 425; 420/435, 420/436

[56] References Cited

U.S. PATENT DOCUMENTS

| | | | |
|---|---|---|---|
| 3,856,513 | 12/1974 | Chen | 75/122 |
| 4,038,073 | 7/1977 | O'Handley et al. | 148/403 |
| 4,056,411 | 11/1977 | Chen et al. | 148/403 |
| 4,067,732 | 1/1978 | Ray | 75/126 P |
| 4,116,682 | 9/1978 | Polk et al. | 148/403 |
| 4,221,592 | 9/1980 | Ray | 75/123 B |

FOREIGN PATENT DOCUMENTS

| | | |
|---|---|---|
| 3021536 | 12/1980 | Fed. Rep. of Germany . |
| 2924280 | 1/1981 | Fed. Rep. of Germany . |

*Primary Examiner*—John P. Sheehan

*Attorney, Agent, or Firm*—Ernest D. Buff; Gerhard H. Fuchs

[57] ABSTRACT

A cobalt based, manganese-containing glassy metal alloy is provided. The alloy has a combination of near-zero magnetostriction (+5 ppm to −1 ppm), high permeability (greater than 5,000) and high saturation induction (about 1.09 T or greater). The alloy has a composition described by the formula $[Co_aFe_{1-a}]_{100-(b+c)}Mn_bB_{c-d}Si_d$, where "a" ranges from about 0.90 to 0.99, "b" ranges from about 2 to 6 atom percent, "c" ranges from about 14 to 20 atom percent and "d" ranges from zero to about 7 atom percent, with the proviso that the minimum B present is 10 atom percent. The alloys of the invention find use in magnetic recording heads, switching power supplies, special magnetic amplifiers and the like.

24 Claims, 2 Drawing Figures

COBALT RICH MANGANESE CONTAINING NEAR-ZERO MAGNETOSTRICTIVE METALLIC GLASSES HAVING HIGH SATURATION INDUCTION

DESCRIPTION

BACKGROUND OF THE INVENTION

1. Field of the Invention

This invention relates to Mn-containing Co-based near-zero magnetostrictive metallic glasses having high saturation induction.

2. Description of the Prior Art

Glassy metal alloys (metallic glasses) are metastable materials lacking any long range order. They are conveniently prepared by rapid quenching from the melt using processing techniques that are conventional in the art. Examples of such metallic glasses and methods for their manufacture are disclosed in U.S. Pat. Nos. 3,856,513, 4,067,732 and 4,142,571.

These patents disclose metallic glasses having excellent soft magnetic properties. One such property, saturation magnetostriction ($\lambda_s$) is related to the fractional change in length that occurs in a magnetic material magnetized to saturation from the demagnetized state. The value of $\lambda_s$, a dimensionless quantity, is usually quoted as the fractional change in length in parts per million (ppm). Henceforth, $\lambda_s$ will be referred to simply as "magnetostriction".

Ferromagnetic alloys having low (near-zero) magnetostriction are disclosed in U.S. Pat. No. 4,038,073. That patent teaches that a combination of high permeability and high saturation induction in near-zero magnetostrictive metallic glasses would find use in a great variety of applications, especially in magnetic recording heads, over a wide frequency range.

Manganese containing metallic glasses, having near-zero magnetostriction and high saturation induction have been disclosed in German Offenlegungschrift No. 30,21,536, published Dec. 12, 1980 and European Patent Application No. 0,021,101, published Jan. 7, 1981. These patent applications teach that the presence of manganese tends to yield a metallic glass wherein the crystallization temperature is above the ferromagnetic Curie temperature. The preferred compositions disclosed by the aforementioned patent applications are depicted in FIG. 1 by the shaded areas, the dashed line and the black dot.

The highest values of saturation induction previously reported for near-zero magnetostrictive metallic glasses having high permeability (greater than 5,000 at a frequency of 1 kHz and an induction level of 0.01 Tesla) are about 100 emu per gram, or about 1 Tesla (T). New applications, such as recording heads used with metallic tapes require magnetic materials having saturation induction higher than 1 T. In other applications, such as switch-mode power supplies, saturation induction higher than 1 T is necessary to accommodate the requirements for miniaturization of electronic components.

SUMMARY OF THE INVENTION

The present invention provides magnetic alloys that are at least about 70% glassy and have a combination of near-zero magnetostriction, high permeability and high saturation induction. The glassy metal alloys of the invention have a composition described by the formula $[Co_aFe_{1-a}]_{100-(b+c)}Mn_bB_{c-d}Si_d$, where "a" ranges from about 0.90 to 0.99, "b" ranges from about 2 to 6 atom percent, "c" ranges from about 14 to 20 atom percent and "d" ranges from 0 to about 7 atom percent, with the proviso that the minimum B present is 10 atom percent. At least one of Co and Fe may be replaced in part by up to 8.4 atom percent of nickel. Up to 1 atom percent of any one of the elements Ti, Zr, Hf, V, Nb, Ta, Cr, Mo, W, Ru, Pd, Cu, Zn, Al, Ge, Sn, Pb and Bi or up to 2 atom percent of C may be present without substantially degrading the magnetic properties of the alloy. These glassy alloys have values of magnetostriction ranging from about −1 ppm to +5 ppm, a value for permeability greater than or approximately equal to 5,000 when measured with a driving field of 1 kHz frequency that produces an induction level of 0.01 T and a value for the saturation induction greater than or equal to 1.09 T. The metallic glasses of this invention are suitable for use especially as magnetic recording head materials. Other uses are found in special magnetic amplifiers, switching power supplies and the like.

BRIEF DESCRIPTION OF THE DRAWINGS

The invention will be more fully understood and further advantages will become apparent when reference is made to the following detailed description of the preferred embodiments of the invention and the accompanying drawings in which.

DESCRIPTION OF THE PREFERRED EMBODIMENT

Figure 1:
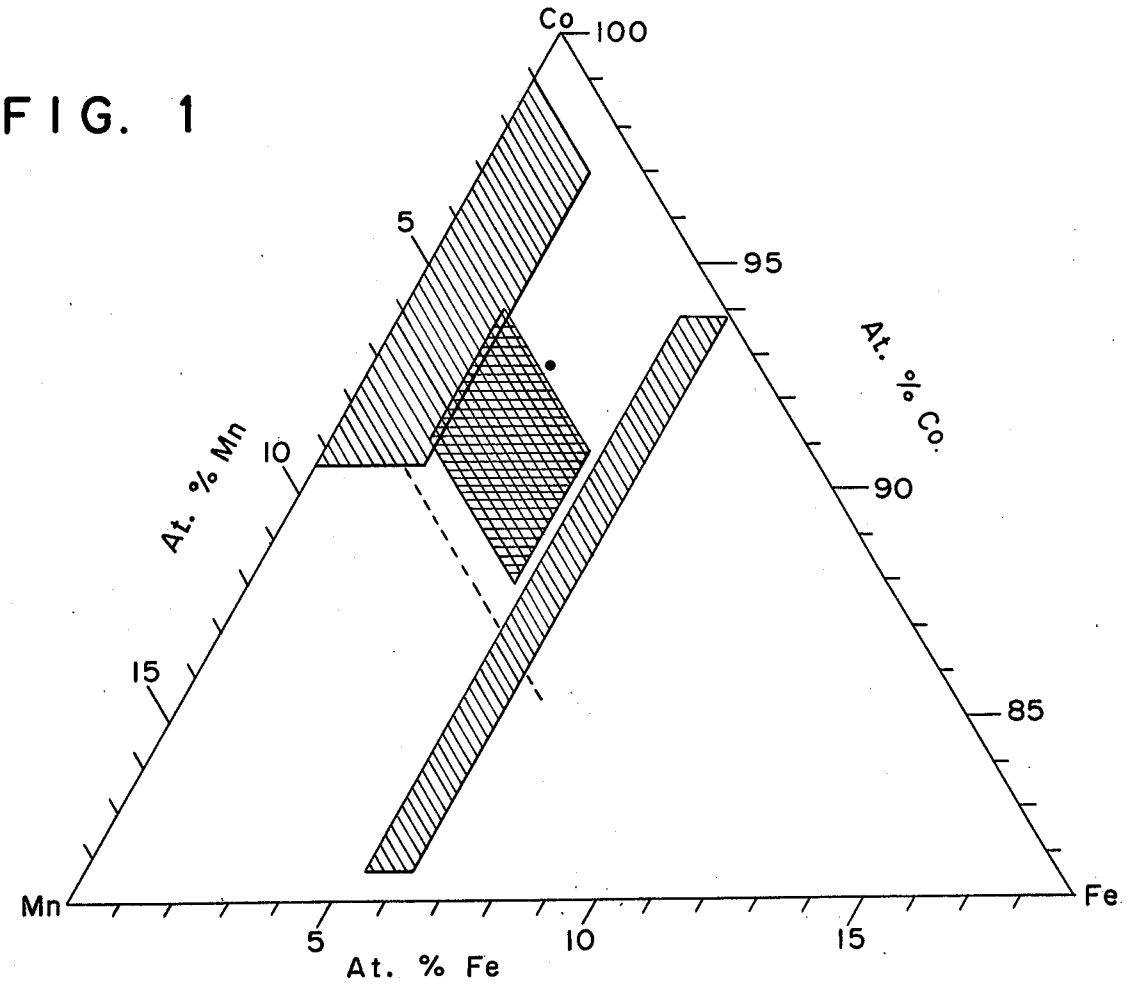
FIG. 1 is a ternary diagram depicting in the cross-thatched area, the transition metal content of preferred cobalt (Co), manganese (Mn) and iron (Fe) containing metallic glasses of the present invention, the shaded areas, the dashed line and the black dot defining prior art compositions.

In accordance with the present invention, there are provided metallic glasses that are at least about 70% glassy and provide a combination of near-zero magnetostriction, high permeability and high saturation induction. The glassy metal alloys of the invention have compositions described by the formula $[Co_aFe_{1-a}]_{100-(b+c)}Mn_bB_{c-d}Si_d$, where "a" ranges from about 0.90 to 0.99, "b" ranges from about 2 to 6 atom percent, "c" ranges from about 14 to 20 atom percent and "d" ranges from 0 to about 7 atom percent, with the proviso that the minimum B present is 10 atom percent. At least one of Co and Fe may be replaced in part by up to 8.4 atom percent of nickel. Up to 1 atom percent of any one of the elements Ti, Zr, Hf, V, Nb, Ta, Cr, Mo, W, Ru, Pd, Cu, Zn, Al, Ge, Sn, Pb and Bi, or up to 2 atom percent of C may be present without substantially degrading the magnetic properties of the alloy. These glassy alloys have values of magnetostriction ranging from about −1 ppm to +5 ppm, a value for permeability greater than or approximately equal to 5,000 when measured with a driving field of 1 kHz frequency that produces an induction level of 0.01 T and a value for the saturation induction greater than or equal to 1.09 T. The purity of the above compositions is that found in normal commercial practice.

The magnetic alloys defined by the formula set forth in the preceding paragraph can, alternatively, be defined by the formula: $Co_iFe_jMn_kB_lSi_m$, where "i" ranges from about 67 to 83 atom percent, "j" ranges from about 0.8 to 8.5 atom percent, "k" ranges from about 2 to 6 atom percent, "l" ranges from about 10 to 20 atom percent and "m" ranges from 0 to about 7 atom percent. Since the effects of certain elemental ratios on the alloys' magnetic properties are better emphasized by the formula utilizing subscripts "a", "b", "c" and "d", as set forth in the preceding paragraph, such formula will be used henceforth in the specification and claims.

The presence of manganese in the glasses is desirable because it tends to raise the crystallization temperature of the glasses to a level above their respective ferromagnetic Curie temperatures. This facilitates optimization of the magnetic properties via post-fabrication heat treatments. As is well known, magnetic annealing, i.e., thermal annealing in the presence of a magnetic field, at temperatures close to the ferromagnetic Curie temperature of a metallic glass generally results in improved properties. If the crystallization temperature is above the anneal temperature, the glassy nature of the alloy will be retained. Such temperature criteria are generally not present in near-zero magnetostrictive metallic glasses that contain no manganese.

The present invention provides metallic glasses that have the excellent soft magnetic properties mentioned hereinabove and which are readily annealed without degradation of such properties resulting from crystallization.

Examples of metallic glasses of the invention include $[Co_{0.925}Fe_{0.075}]_{80}Mn_2B_{13}Si_5$, $[Co_{0.925}Fe_{0.075}]_{80}Mn_4B_{14}Si_2$, $[Co_{0.95}Fe_{0.05}]_{78}Mn_4B_{13}Si_5$, $[Co_{0.97}Fe_{0.03}]_{78}Mn_4B_{13}Si_5$, $[Co_{0.97}Fe_{0.03}]_{78}Mn_4B_{12}Si_6$, $[Co_{0.98}Fe_{0.02}]_{78}Mn_4B_{13}Si_5$, $[Co_{0.98}Fe_{0.02}]_{78}Mn_4B_{12}Si_6$, $Co_{75.08}Fe_{1.92}Ni_2Mn_3B_{13}Si_5$, $[Co_{0.80}Fe_{0.10}Ni_{0.10}]_{80}Mn_2B_{18}$, $[Co_{0.80}Fe_{0.10}Ni_{0.10}]_{81}Mn_3B_{16}$, $[Co_{0.80}Fe_{0.10}Ni_{0.10}]_{82}Mn_4B_{10}Si_4$ and $[Co_{0.975}Fe_{0.025}]_{78}Mn_4Mo_1B_{12}Si_5$.

The presence of nickel in some of the glasses of the invention, where the magnetic properties are not substantially affected, is desirable since the net cobalt content in the glasses can then be reduced. Considering the high cost of cobalt, introduction of nickel into the glass system makes the glasses economically more viable.

Additions of small amounts of other elements referred to above may facilitate glass formation for these metallic alloys.

As mentioned previously, certain applications of magnetic materials (e.g., magnetic recording heads) require a combination of high permeability and high saturation induction.

Permeability of ferromagnetic materials is the ratio of the induction to the applied magnetic field. Permeability thus defined is also known as "effective" permeability. This effective permeability is both a function of the frequency of the applied magnetic field and of the induction level attained in the magnetic material. The value of permeability obtained with a driving field of frequency 1 kHz that causes the induction to be 0.01 T is usually considered the norm for the sake of comparison of various magnetic materials, and is thus the value generally quoted for a magnetic material. When a material is to be employed in a magnetic recording head, a higher permeability leads to an increased response to the driving fields caused by the input signals.

With the advent of metallic tapes containing magnetic particles of high coercivity, higher saturation induction in the recording head material would record signals on the tape more efficiently and would thus improve the quality of recording achieved. As a result, there is need for a combination of high permeability and high saturation induction in alloys appointed for use in magnetic recording heads. The permeability of the glassy metal alloys of this invention after annealing is at least 5,000, when measured at 1 KHz and 0.01 T as described above. In many of the glasses relating to this invention, appropriately chosen anneal conditions yield permeabilities well in excess of 12,000.

In accordance with the formula $[Co_aFe_{1-a}]_{100-(b+c)}Mn_bB_{c-d}Si_d$ for glasses relating to this invention, "$b$" is specified to vary from about 2 to 6 atom percent. Any Mn content outside this range leads to a reduction in the saturation induction to a level below 1.09 T, which level would be undesirable for applications of the type referred to hereinabove. This is illustrated in Table I. Values of "c" have been specified to lie in a range from about 14 to 20 atom percent. With values of "c" below 14 atom percent, the glassy alloys cannot be consistently produced. For values of "c" above 20 atom percent, the saturation induction is reduced below 1.09 T. Such a reduction in saturation induction also occurs when "d" is larger than 7 atom percent. These features are shown by example in Table I.

TABLE I

Examples of prior art metallic glasses illustrating the loss in saturation induction, $B_s$, obtained when compositions fall outside the scope of the present invention. $B_s$ values obtained in the glasses of this invention are listed in Tables II to VI.

| Composition (at. %) | | | | | Saturation Induction |
|---|---|---|---|---|---|
| Co | Fe | Mn | B | Si | $B_s$ (T)+ |
| 70.5 | 4.5 | 0 | 10 | 15 | 0.65 |
| 74.2 | 4.8 | 0 | 10.5 | 10.5 | 1.03* |
| 80.8 | 2.8 | 3.4 | 8 | 5 | 0.98* |
| 69.5 | 1 | 4.5 | 15 | 10 | 0.75 |
| 71.5 | 0 | 6 | 14 | 8.5 | 0.95 |
| **70 | 2 | 6 | 18 | 4 | 0.99 |
| 66.6 | 4.4 | 8 | 10.5 | 10.5 | 1.00* |

+1 T = 10 kG
*A value of 8 g/cc has been assumed for the mass density.
**This composition is not specifically taught by the prior art.

Referring to FIG. 1, there is shown the content in the metallic glasses of the elements Co, Mn and Fe, expressed as a percent fraction of the total transition metal content therein. The total transition metal content in the glasses, defined as the sum of the atom percents of Co, Mn, and Fe, is equal to "(100−c)" atom percent in accordance with the formula set forth in the preceding paragraph.

Figure 2:
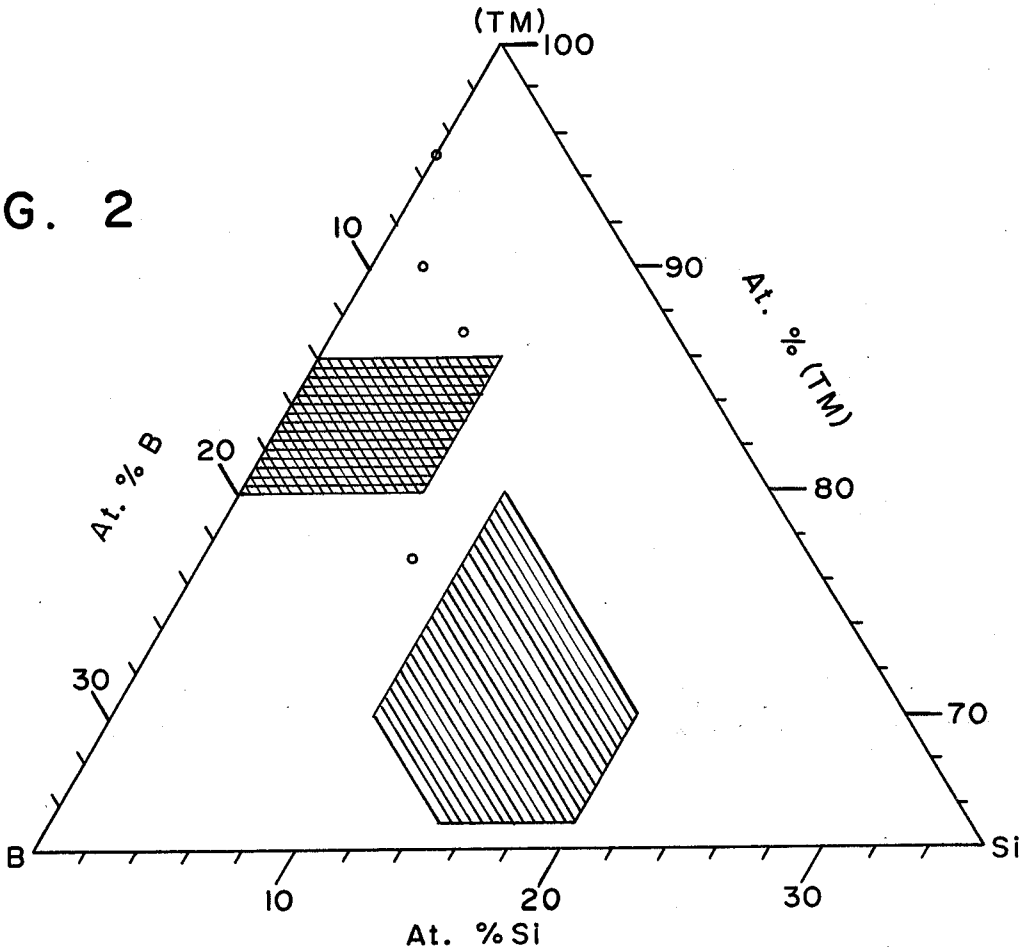
FIG. 2 is a ternary diagram depicting the transition metal (TM), boron (B) and silicon (Si) contents of the compositions of the present invention (cross-thatched area), the shaded area and the black dots defining prior art compositions.

Glasses wherein "b" varies between 2 and 3.5 atom percent and/or "a" varies between 0.90 and 0.93, fall within an area that does not include the black dot shown in FIG. 1, since FIG. 1 and FIG. 2 must be read together as defining the range of compositions. As shown in FIG 2, the compositions of the present invention do not include those disclosed by the prior art. As shown in FIG. 2, the glasses of the present invention contain lower combined amounts of B and Si than prior art glasses. The reduced combined amounts of B and Si present in glasses of the present invention increase the values of saturation induction afforded by the glasses.

For some applications, it may be desirable to use a material with a small positive magnetostriction. For example, a low magnetostriction alloy of higher saturation induction or higher ferromagnetic Curie temperature than is available in an alloy of zero magnetostriction may be used in applications where a smaller rate of variation in induction with temperature is desired. Such near-zero magnetostrictive alloys are obtained for "a" in the range of about 0.90 to 0.96. The absolute value of the magnetostriction of these metallic glasses is less than about +5 ppm (i.e., the magnetostriction ranges from about +5 ppm to +1 ppm). Examples of these glasses are shown in Table II.

Among the near-zero magnetostrictive glasses, a preferred set of compositions arise when "c" is about 14 to 18 atom percent. For these glasses, the saturation induction is close to or greater than 1.2 T. This is especially the case when "c" ranges from about 16 to 18 atom percent and "d" ranges from zero to about 5 atom percent. Table II contains examples of these glasses.

TABLE II

Saturation induction of glasses defined by the formula $[Co_aFe_{1-a}]_{100-(b+c)}Mn_bB_{c-d}Si_d$, where "a" ranges from about 0.90 to 0.96, having magnetostriction values ranging from about +5 ppm to +1 ppm.

| Composition | | | | |
|---|---|---|---|---|
| a | b | c | d | $B_s$ (T) |
| 0.925 | 4 | 20 | 5 | 1.12 |
| 0.925 | 4 | 19 | 5 | 1.15 |
| 0.925 | 2 | 18 | 5 | 1.22 |
| 0.925 | 4 | 18 | 5 | 1.23 |
| 0.925 | 4 | 18 | 2 | 1.31 |
| 0.925 | 4 | 16 | 2 | 1.33 |
| 0.935 | 4 | 18 | 5 | 1.31 |
| 0.95 | 4 | 18 | 5 | 1.25 |

Near-zero magnetostrictive alloys of the present invention are also obtained by introduction of nickel into the cobalt-iron complex, i.e., Ni substituting for Co or Fe or both. Up to 8.4 atom percent of nickel may be added to affect this substitution. An example of a glass to which a small amount of Ni has been added in the aforesaid manner is $Co_{75.08}Fe_{1.92}Ni_2Mn_3B_{13}Si_5$. The glass has a saturation induction of about 1.12 T and a value of magnetostriction of about zero ppm. Examples wherein high levels of nickel have been introduced into the basic Co-Fe-Mn-B-Si system are presented in Table III. This table illustrates a preferred range of compositions wherein high levels of nickel have been substituted. In this preferred range of compositions, the glasses are described by the formula $[Co_{0.80}Fe_{0.10}Ni_{0.10}]_xMn_yB_{z-w}Si_w$, where "x" is equal to 100−(y+z) and ranges from about 78 to 84 atom percent, "y" ranges from about 2 to 5 atom percent, "z" ranges from about 14 to 18 atom percent and "w" ranges from zero to about 5 atom percent. Each of the compositions of Table III evidences saturation induction levels close to or greater than 1.2 T. Consequently, these Table III compositions are preferred.

TABLE III

Saturation induction of glasses defined by the formula $[Co_{0.80}Fe_{0.10}Ni_{0.10}]_xMn_yB_{z-w}Si_w$. The magnetostriction values range from about +5ppm to +1ppm.

| Composition (at. %)+ | | | | |
|---|---|---|---|---|
| x | y | z | w | $B_s$ (T) |
| 80 | 2 | 18 | 0 | 1.15 |
| 82 | 2 | 16 | 0 | 1.26 |
| 80 | 2 | 18 | 4 | 1.25 |
| 81 | 3 | 16 | 0 | 1.24 |
| 81 | 3 | 16 | 4 | 1.30 |
| 80 | 4 | 16 | 0 | 1.25 |
| 80 | 4 | 16 | 2 | 1.31 |

TABLE III-continued

Saturation induction of glasses defined by the formula $[Co_{0.80}Fe_{0.10}Ni_{0.10}]_xMn_yB_{z-w}Si_w$. The magnetostriction values range from about +5ppm to +1ppm.

| Composition (at. %)+ | | | | |
|---|---|---|---|---|
| x | y | z | w | $B_s$ (T) |
| 82 | 4 | 14 | 2 | 1.24 |
| 82 | 4 | 14 | 4 | 1.33 |
| 78 | 4 | 18 | 5 | 1.14 |
| 84 | 2 | 14 | 4 | 1.11 |

+"x" equals 100 − (y + z).

Near-zero magnetostrictive glasses, with magnetostriction values from about +5 ppm to +1 ppm are produced when up to 1 atom percent of any one of the elements Ti, Zr, Hf, V, Nb, Ta, Cr, Mo, W, Ru, Pd, Cu, Zn, Al, Ge, Sn, Pb and Bi, or up to 2 atom percent of C are introduced into the basic Co-Fe-Mn-B-Si system. The saturation induction in such glasses is greater than about 1.1 T. Examples of these glasses are given in Table IV.

TABLE IV

Examples of the saturation induction of glasses of this invention, wherein a small amount of a trace metal or carbon is introduced into the basic Co—Fe—Mn—B—Si system. The magnetostriction values in the examples below range from about +1ppm to −1ppm.

| Composition (at. %) | $B_s$ (T) |
|---|---|
| $Co_{76.05}Fe_{1.95}Mn_4Zr_{0.5}B_{12.5}Si_5$ | 1.13 |
| $Co_{76.05}Fe_{1.95}Mn_4Hf_{0.5}B_{12.5}Si_5$ | 1.10 |
| $Co_{76.05}Fe_{1.95}Mn_4V_{0.5}B_{12.5}Si_5$ | 1.23 |
| $Co_{76.05}Fe_{1.95}Mn_4Nb_{0.5}B_{12.5}Si_5$ | 1.20 |
| $Co_{76.05}Fe_{1.95}Mn_4Ta_{0.5}B_{12.5}Si_5$ | 1.11 |
| $Co_{76.05}Fe_{1.95}Mn_4Mo_{0.5}B_{12.5}Si_5$ | 1.16 |
| *$Co_{76.05}Fe_{1.95}Mn_4W_{0.5}B_{12.5}Si_5$ | 1.14 |
| $Co_{76.05}Fe_{1.95}Mn_4Pd_{0.5}B_{12.5}Si_5$ | 1.12 |
| $Co_{76.05}Fe_{1.95}Mn_4Cu_{0.5}B_{12.5}Si_5$ | 1.21 |
| *$Co_{76.05}Fe_{1.95}Mn_4Al_{0.5}B_{12.5}Si_5$ | 1.22 |
| $Co_{76.05}Fe_{1.95}Mn_4Ge_{0.5}B_{12.5}Si_5$ | 1.17 |
| $Co_{76.05}Fe_{1.95}Mn_4Ru_1B_{12}Si_5$ | 1.16 |
| $Co_{76.05}Fe_{1.95}Mn_4Mo_1B_{12}Si_5$ | 1.18 |
| $Co_{76.05}Fe_{1.95}Mn_4B_{11}Si_5C_2$ | 1.21 |
| $Co_{76.05}Fe_{1.95}Mn_4B_{12}Si_5C_1$ | 1.16 |

*magnetostriction values range from about +3ppm to +1ppm.

For other applications, such as magnetic recording heads, magnetostriction values close to zero are essential. Such glasses, i.e., glasses with values of magnetostriction ranging from about +1 ppm to −1 ppm are obtained for values of "a" ranging from about 0.96 to 0.99. Among these glasses, a most preferred range of values of "a" is from about 0.97 to 0.98, wherein the magnetostriction varies from about +0.5 ppm to −0.5 ppm. It will be appreciated here that a change in the value of "a" by about 0.01 corresponds approximately to a change in the cobalt content of at least about 0.8 atom percent. Examples of these glasses are found in Table V.

TABLE V

Saturation induction of glasses defined by the formula $[Co_aFe_{1-a}]_{100-(b+c)}Mn_bB_{c-d}Si_d$ having magnetostriction values ranging from about +1ppm to −1ppm.

| Composition | | | | |
|---|---|---|---|---|
| a | b | c | d | $B_s$ (T) |
| 0.96 | 4 | 18 | 5 | 1.23 |
| 0.97 | 4 | 18 | 6 | 1.18 |
| 0.975 | 4 | 18 | 5 | 1.25 |
| 0.975 | 4 | 18 | 6 | 1.26 |
| 0.985 | 4 | 18 | 6 | 1.15 |

TABLE V-continued

Saturation induction of glasses defined by the formula $[Co_aFe_{1-a}]_{100-(b+c)}Mn_bB_{c-d}Si_d$ having magnetostriction values ranging from about +1ppm to −1ppm.

| Composition | | | | |
|---|---|---|---|---|
| a | b | c | d | $B_s$ (T) |
| 0.988 | 2 | 14 | 1 | 1.20 |

In cobalt rich, zero-magnetostrictive systems, the ratio of cobalt to iron contents, i.e., (a/(1−a)), critically controls the value of the magnetostriction. For Mn containing systems of glasses, zero magnetostriction is reached when this ratio varies from about 35 to 40. In prior art glasses that contain no manganese, this ratio is between about 14 and 16. Replacement of Co and/or Fe with Ni does not seriously affect this ratio. For example, the glass $Co_{75.08}Fe_{1.92}Ni_2Mn_3B_{13}Si_5$ (cobalt to iron ratio of about 39) has a magnetostriction of zero ppm.

For compositions having extremely low magnetostriction values, and in which "a" is between about 0.96 and 0.99, preferred values for "b" range from about 3 to 5 atom percent, preferred values for "c" range from about 16 to 18 atom percent and preferred values for "d" range from about 2 to 6 atom percent. Compositions having these preferred values for "a", "b", "c", and "d" evidence high saturation induction (above about 1.15 T), high permeability (above about 11,000), extremely low magnetostriction (between about +0.5 ppm and −0.5 ppm), relatively high crystallization temperature (about 700 K.) and a relatively large separation between the crystallization and the ferromagnetic Curie temperatures (about 30 to 50 K.). As mentioned hereinabove, the separation between crystalliztion and ferromagnetic Curie temperatures afforded by the glasses of the invention facilitates optimization of annealing procedures. Typical examples of such metallic glasses include $[Co_{0.97}Fe_{0.03}]_{78}Mn_4B_{13}Si_5$, $[Co_{0.98}Fe_{0.02}]_{78}Mn_4B_{12}Si_6$, $[Co_{0.97}Fe_{0.03}]_{78}Mn_4B_{12}Si_6$ and $[Co_{0.98}Fe_{0.02}]_{78}Mn_4B_{13}Si_5$.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLES

1. Sample Preparation.

Glassy metal alloys, designated samples No. 1 to 25, were rapidly quenched (about $10^6$ K./s) from the melt following the techniques taught by Narasimhan in U.S. Pat. No. 4,142,571. The resulting ribbons, typically 25 to 50 mm thick and 0.3 to 2.5 cm wide, were determined to be free of significant crystallinity by X-ray diffractometry using Cu-$K_\alpha$ radiation, and scanning calorimetry. Ribbons of the glassy metal alloys were strong, shiny, hard and ductile.

2. Magnetic Measurements.

Permeability was measured on closed-magnetic-path toroidal samples using standard techniques. The toroidal samples were prepared by winding continuous ribbons of the glassy metal alloys onto bobbins (about 4 cm O.D.). Each sample contained from 2 to 10 g of ribbon. Insulated primary windings (numbering at least 3) and secondary windings (numbering at least 45) were applied to the toroids.

The moment, M, was measured with a commercial vibrating sample magnetometer (Princeton Applied Research). The ribbon was cut into several small squares (approximately 2 mm×2 mm), which were randomly oriented about their normal direction, their plane being parallel to an applied field varying from zero to about 700 kA/m. By using the measured mass density, the induction, B, was then calculated. The data on induction, obtained when the applied field, H, varied from about 500 kA/m to 700 kA/m, were then fitted to a law of approach to saturation described by the equation $B=B_s(1+(\alpha/H)+(\beta/H^2))$, to obtain the saturation induction, $B_s$. In this equation, $\alpha$ and $\beta$ are some constants.

The ferromagnetic Curie temperature was determined using an inductance method. Differential scanning calorimetry was used to determine the crystallization temperatures, with the usual scanning rate of 20 K./min.

Magnetostriction measurements employed metallic strain gauges (BLH electronics), which were bonded (Eastman-910 cement) between two short lengths of ribbon. The ribbon axis and gauge axis were parallel. The magnetostriction was then determined using a method described in Review of Scientific Instruments, vol. 51, p. 382 (1980).

The samples and their values of magnetostriction, permeability, crystallization temperature, Curie temperature and saturation induction are set forth in Table VI below.

TABLE VI

Examples of alloys of this invention and their soft magnetic properties.

| | | COMPOSITION | | | | | |
|---|---|---|---|---|---|---|---|
| No. | | Co | Fe | Ni | Mn | B | Si |
| 1 | at. % | 82 | 2 | 0 | 2 | 14 | 0 |
| | wt. % | 92.8 | 2.2 | 0 | 2.1 | 2.9 | 0 |
| 2 | at. % | 80 | 2 | 0 | 2 | 16 | 0 |
| | wt. % | 92.2 | 2.2 | 0 | 2.2 | 3.4 | 0 |
| 3 | at. % | 74 | 6 | 0 | 2 | 13 | 5 |
| | wt. % | 85.7 | 6.6 | 0 | 2.2 | 2.8 | 2.7 |
| 4 | at. % | 72.2 | 5.8 | 0 | 2 | 16 | 4 |
| | wt. % | 85.4 | 6.6 | 0 | 2.2 | 3.5 | 2.3 |
| 5 | at. % | 71 | 6 | 0 | 3 | 16 | 4 |
| | wt. % | 84.2 | 6.7 | 0 | 3.3 | 3.5 | 2.3 |
| 6 | at. % | 73 | 8 | 0 | 3 | 16 | 0 |
| | wt. % | 84.6 | 8.8 | 0 | 3.2 | 3.4 | 0 |
| 7 | at. % | 78.2 | 0.8 | 0 | 3 | 13 | 5 |
| | wt. % | 90.4 | 0.9 | 0 | 3.2 | 2.7 | 2.8 |
| 8 | at. % | 73 | 3 | 0 | 4 | 20 | 0 |
| | wt. % | 87.7 | 3.4 | 0 | 4.5 | 4.4 | 0 |
| 9 | at. % | 72.2 | 5.8 | 0 | 4 | 16 | 2 |
| | wt. % | 84.6 | 6.5 | 0 | 4.4 | 3.4 | 1.1 |
| 10 | at. % | 70.3 | 5.7 | 0 | 4 | 15 | 5 |
| | wt. % | 83.1 | 6.4 | 0 | 4.4 | 3.3 | 2.8 |
| 11 | at. % | 67 | 8.5 | 0 | 4.5 | 16 | 4 |
| | wt. % | 79.7 | 9.6 | 0 | 5.0 | 3.5 | 2.2 |
| 12 | at. % | 75 | 4 | 0 | 5 | 10 | 6 |
| | wt. % | 85.1 | 4.3 | 0 | 5.3 | 2.1 | 3.2 |
| 13 | at. % | 73 | 4 | 0 | 5 | 12 | 6 |
| | wt. % | 84.4 | 4.4 | 0 | 5.4 | 2.5 | 3.3 |
| 14 | at. % | 73 | 2 | 0 | 5 | 17 | 3 |
| | wt. % | 86.8 | 2.3 | 0 | 5.5 | 3.7 | 1.7 |
| 15 | at. % | 71 | 4 | 0 | 5 | 13 | 7 |
| | wt. % | 83.3 | 4.5 | 0 | 5.5 | 2.8 | 3.9 |
| 16 | at. % | 69 | 6 | 0 | 5 | 18 | 2 |
| | wt. % | 82.5 | 6.8 | 0 | 5.6 | 4.0 | 1.1 |
| 17 | at. % | 72.5 | 3.5 | 0 | 6 | 12 | 6 |
| | wt. % | 83.9 | 3.8 | 0 | 6.5 | 2.5 | 3.3 |
| 18 | at. % | 70.5 | 3.5 | 0 | 6 | 13 | 7 |
| | wt. % | 82.8 | 3.9 | 0 | 6.6 | 2.8 | 3.9 |
| 19 | at. % | 64 | 8 | 8 | 2 | 16 | 2 |
| | wt. % | 75.0 | 8.9 | 9.3 | 2.2 | 3.4 | 1.2 |
| 20 | at. % | 66.4 | 8.3 | 8.3 | 3 | 14 | 0 |
| | wt. % | 75.5 | 8.9 | 9.4 | 3.3 | 2.9 | 0 |
| 21 | at. % | 64.8 | 8.1 | 8.1 | 3 | 12 | 4 |

TABLE VI-continued

Examples of alloys of this invention and their soft magnetic properties.

| | | | | | | | |
|---|---|---|---|---|---|---|---|
| | wt. % | 74.1 | 8.8 | 9.2 | 3.2 | 2.5 | 2.2 |
| 22 | at. % | 63.2 | 7.9 | 7.9 | 3 | 18 | 0 |
| | wt. % | 74.7 | 8.8 | 9.3 | 3.3 | 3.9 | 0 |
| 23 | at. % | 62.4 | 7.8 | 7.8 | 4 | 13 | 5 |
| | wt. % | 72.5 | 8.6 | 9.0 | 4.3 | 2.8 | 2.8 |
| 24 | at. % | $Co_{76.05}Fe_{1.95}Mn_4Mo_{0.5}B_{12.5}Si_5$ | | | | | |
| | wt. % | $Co_{87.3}Fe_{2.1}Mn_{4.3}Mo_{1.0}B_{2.6}Si_{2.7}$ | | | | | |
| 25 | at. % | $Co_{76.05}Fe_{1.95}Mn_4B_{11}Si_5C_2$ | | | | | |
| | wt. % | $Co_{88.0}Fe_{2.1}Mn_{4.3}B_{2.3}Si_{2.8}C_{0.5}$ | | | | | |

| No. | $\lambda_s$ (ppm) | $T_{x1}$ (K) | $T_c$ (K) | $B_s$ (T) | $\mu$(1 kHz; 0.01 T) |
|---|---|---|---|---|---|
| 1 | −0.5 | 654 | 675 | 1.15 | 6,600 |
| 2 | +1.0 | 644 | 694 | 1.25 | 7,700 |
| 3 | 2.3 | 705 | 680 | 1.22 | 10,600 |
| 4 | 1.9 | 727 | 707 | 1.13 | 16,100 |
| 5 | 3.2 | 730 | 713 | 1.21 | 8,600 |
| 6 | 3.4 | 662 | 694 | 1.24 | 5,000 |
| 7 | 0.4 | 671 | 694 | 1.23 | 9,800 |
| 8 | 0.8 | 701 | 693 | 1.22 | 6,200 |
| 9 | 2.8 | 692 | 684 | 1.31 | 7,500 |
| 10 | 2.1 | 728 | 693 | 1.12 | 9,900 |
| 11 | 4.0 | 726 | 718 | 1.24 | 7,400 |
| 12 | 4.9 | 665 | 634 | 1.24 | 6,300 |
| 13 | 2.6 | 691 | 624 | 1.19 | 8,200 |
| 14 | 0 | 720 | 684 | 1.12 | 7,500 |
| 15 | 2.6 | 719 | 679 | 1.13 | 9,100 |
| 16 | 1.5 | 726 | 685 | 1.15 | 6,600 |
| 17 | 3.0 | 695 | 691 | 1.19 | 9,100 |
| 18 | 3.4 | 723 | 665 | 1.09 | 11,100 |
| 19 | 2.6 | 695 | 670 | 1.20 | 8,000 |
| 20 | 2.1 | 699 | 679 | 1.17 | 6,400 |
| 21 | 3.2 | 683 | 666 | 1.30 | 7,200 |
| 22 | 2.1 | 687 | 663 | 1.21 | 9,400 |
| 23 | 3.2 | 696 | 674 | 1.14 | 8,300 |
| 24 | 0 | 681 | 681 | 1.16 | 8,800 |
| 25 | 0.9 | 673 | 685 | 1.21 | 6,100 |

Notes:
(i) $T_{x1}$ is the first crystallization temperature and $T_c$ is the ferromagnetic Curie temperature.
(ii) Permeability, $\mu$, was measured on samples annealed for about 10 to 30 minutes at temperatures from about 540 to 620K in the presence of an applied field of up to about 4 kA/m.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. A magnetic alloy which is at least about 70% glassy, has a combination of near-zero magnetostriction ranging from about −1 ppm to +5 ppm, high permeability of at least about 5,000, when measured with a driving field of 1 kHz frequency that produces an induction level of 0.01 T, and high saturation induction of at least about 1.09 T, and which is described by the formula $[Co_aFe_{1-a}]_{100-(b+c)}Mn_bB_{c-d}Si_d$, where "a" ranges from about 0.90 to 0.99, "b" ranges from about 2 to 6 atom percent, "c" ranges from about 14 to 20 atom percent and "d" ranges from about 0 to 7 atom percent with the proviso that the minimum B present is 10 atom percent.

2. The magnetic alloy of claim 1, wherein "c" ranges from about 14 to 18 atom percent.

3. The magnetic alloy of claim 1, wherein "c" ranges from about 16 to 18 atom percent and "d" ranges from zero to about 5 atom percent.

4. The magnetic alloy of claim 1, wherein "a" ranges from about 0.96 to 0.99.

5. The magnetic alloy of claim 4, wherein "a" ranges from about 0.97 to 0.98.

6. The magnetic alloy of claim 4, wherein "b" ranges from about 3 to 5 atom percent, "c" ranges from about 16 to 18 atom percent and "d" ranges from about 2 to 6 atom percent.

7. The magnetic alloy of claim 5, wherein "b" ranges from about 3 to 5 atom percent, "c" ranges from about 16 to 18 atom percent and "d" ranges from about 2 to 6 atom percent.

8. The magnetic alloy of claim 1, wherein at least one of elements Co and Fe is replaced in part by up to 8.4 atom percent nickel.

9. The magnetic alloy of claim 8, wherein the elements cobalt, iron and nickel are present in the ratio of 0.80:0.10:0.10.

10. The magnetic alloy of claim 9, described by the formula $[Co_{0.80}Fe_{0.10}Ni_{0.10}]_xMn_yB_{z-w}Si_w$, where "x" ranges from about 78 to 84 atom percent, "y" ranges from about 2 to 5 atom percent, "z" ranges from about 14 to 18 atom percent and "w" ranges from zero to about 5 atom percent.

11. The magnetic alloy of claim 1, wherein up to 1 atom percent of one of the elements Ti, Zr, Hf, V, Nb, Ta, Cr, Mo, W, Ru, Pd, Cu, Zn, Al, Ge, Sn, Pb, and Bi are present.

12. The magnetic alloy of claim 11, wherein "a" ranges from about 0.96 to 0.99.

13. The magnetic alloy of claim 12, wherein "a" ranges from about 0.97 to 0.98.

14. The magnetic alloy of claim 12, wherein "b" ranges from about 3 to 5 atom percent, "c" ranges from about 16 to 18 atom percent and "d" ranges from about 2 to 6 atom percent.

15. The magnetic alloy of claim 13, wherein "b" ranges from about 35 to 5 atom percent, "c" ranges from about 16 to 18 atom percent and "d" ranges from about 2 to 6 atom percent.

16. The magnetic alloy of claim 1, wherein up to 2 atom percent of C is present.

17. The magnetic alloy of claim 16, wherein "a" ranges from about 0.96 to 0.99.

18. The magnetic alloy of claim 17, wherein "a" ranges from about 0.97 to 0.98.

19. The magnetic alloy of claim 17, wherein "b" ranges from about 3 to 5 atom percent, "c" ranges from about 16 to 18 atom percent and "d" ranges from about 2 to 6 atom percent.

20. The magnetic alloy of claim 18, wherein "b" ranges from about 3 to 5 atom percent, "c" ranges from about 16 to 18 atom percent and "d" ranges from about 2 to 6 percent.

21. The magnetic alloy of claim 7, having the formula $[Co_{0.97}Fe_{0.03}]_{78}Mn_4B_{13}Si_5$.

22. The magnetic alloy of claim 7, having the formula $[Co_{0.97}Fe_{0.03}]_{78}Mn_4B_{12}Si_6$.

23. The magnetic alloy of claim 7, having the formula $[Co_{0.98}Fe_{0.02}]_{78}Mn_4B_{13}Si_5$.

24. The magnetic alloy of claim 7, having the formula $[Co_{0.98}Fe_{0.02}]_{78}Mn_4B_{12}Si_6$.

* * * * *

UNITED STATES PATENT AND TRADEMARK OFFICE

CERTIFICATE OF CORRECTION

PATENT NO. : 4,439,253

DATED : March 27, 1984

INVENTOR(S) : V.R.V. Ramanan

It is certified that error appears in the above-identified patent and that said Letters Patent are hereby corrected as shown below:

Col. 10, line 41, "35" should read -- 3 --

Signed and Sealed this

*Twenty-eighth* Day of *August 1984*

[SEAL]

*Attest:*

GERALD J. MOSSINGHOFF

*Attesting Officer*

*Commissioner of Patents and Trademarks*